US008602391B2

(12) United States Patent
Milicic

(10) Patent No.: US 8,602,391 B2
(45) Date of Patent: Dec. 10, 2013

(54) TELESCOPICALLY COLLAPSIBLE SCISSOR CAR JACK

(75) Inventor: Dragan Milicic, Ingolstadt (DE)

(73) Assignee: Audi AG, Ingolstadt (DE)

( * ) Notice: Subject to any disclaimer, the term of this patent is extended or adjusted under 35 U.S.C. 154(b) by 309 days.

(21) Appl. No.: 13/054,157

(22) PCT Filed: Jul. 15, 2009

(86) PCT No.: PCT/EP2009/059083

§ 371 (c)(1),
(2), (4) Date: Jan. 14, 2011

(87) PCT Pub. No.: WO2010/007104

PCT Pub. Date: Jan. 21, 2010

(65) Prior Publication Data

US 2011/0114905 A1 May 19, 2011

(30) Foreign Application Priority Data

Jul. 15, 2008 (DE) ..... 10 2008 040 432

(51) Int. Cl.

| | |
|---|---|
| ***B66F 3/22*** | (2006.01) |
| ***B66F 3/00*** | (2006.01) |
| ***B66F 3/36*** | (2006.01) |
| ***B66F 3/08*** | (2006.01) |

(52) U.S. Cl.
USPC ..... 254/122; 254/124; 254/126; 254/100; 254/103; 254/98

(58) Field of Classification Search
USPC ..... 254/100, 103, 98, 122–126
See application file for complete search history.

(56) References Cited

U.S. PATENT DOCUMENTS

| | | | | |
|---|---|---|---|---|
| 4,583,713 | A * | 4/1986 | Fukura et al. | 254/126 |
| 5,176,362 | A | 1/1993 | Seksaria et al. | |
| 6,161,816 | A * | 12/2000 | Kikuchi | 254/126 |
| 6,695,289 | B1 * | 2/2004 | Mickael | 254/122 |
| 2004/0031954 | A1 * | 2/2004 | Garceau | 254/126 |
| 2007/0018145 | A1 * | 1/2007 | Wang | 254/126 |
| 2008/0006801 | A1 | 1/2008 | Kikuchi | |

FOREIGN PATENT DOCUMENTS

| | | | |
|---|---|---|---|
| CN | 100575238 | C | 12/2009 |
| EP | 1 878 690 | A1 | 1/2008 |
| WO | 2005/070812 | A1 | 8/2005 |

* cited by examiner

*Primary Examiner* — Monica Carter
*Assistant Examiner* — Nirvana Deonauth
(74) *Attorney, Agent, or Firm* — Laurence A. Greenberg; Werner H. Stemer; Ralph E. Locher

(57) ABSTRACT

A scissor car jack includes a spindle, a base, a support head, a cross-member, and a spindle support with a threaded bore for holding the spindle. The base and support head are rotatably connected to the crossmember and the spindle support by way of a respective support arm, and wherein the support arms are connected with one another in the area of the base and the support head and/or in the area of the crossmember and the spindle support, and the spindle is coupled to the crossmember and the spindle support so that when the spindle is rotated, the distance between the spindle support and the crossmember can be changed. The length of the support arms can be changed telescopically and can be locked in the extended state by way of locking pins so that the scissor jack can be collapsed into a smaller volume, in particular for purposes of stowage.

28 Claims, 20 Drawing Sheets

FIG. 12
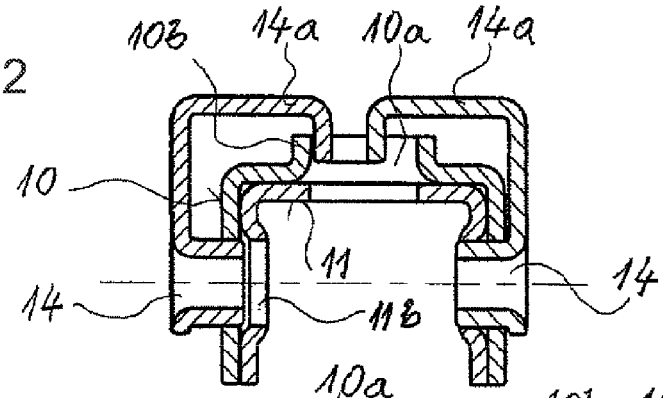
FIG. 11
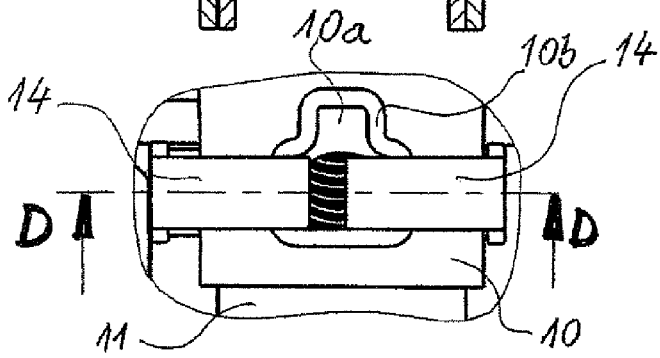
FIG. 13
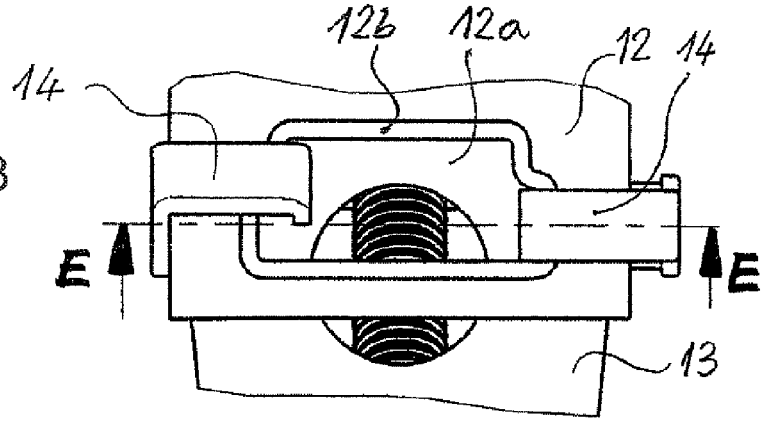
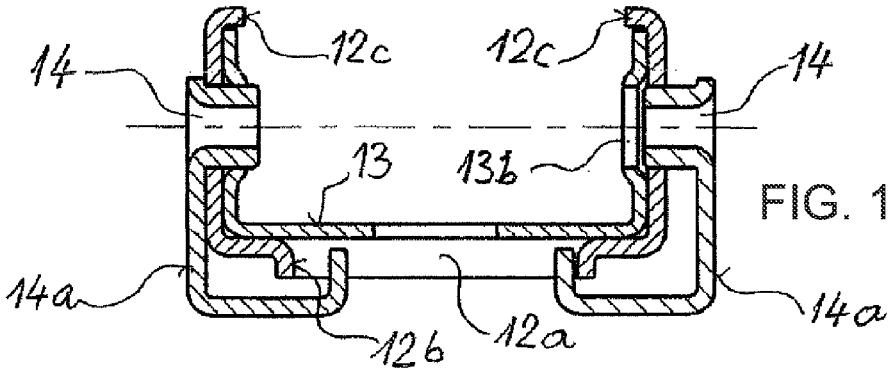
FIG. 14

TELESCOPICALLY COLLAPSIBLE SCISSOR CAR JACK

BACKGROUND OF THE INVENTION

Field of the Invention

The present invention relates to a scissor jack with a spindle, a foot, a carrying head, a crossmember, and a spindle mount. The spindle mount has a bore with an internal thread for receiving the spindle. The foot and the carrying head are reotatably connected to the crossmember and the spindle mount by way of a respective carrying arm. The carrying arms are coupled to one another in the region of the foot and of the carrying head and/or in the region of the crossmember and of the spindle mount. The spindle is coupled to the crossmember and the spindle mount, so that, upon rotation of the spindle, it is possible to change the distance between the spindle mount and the crossmember.

It is known to use a car jack to raise passenger vehicles in order to change tires. Since the trunk of a passenger vehicle, nowadays, is packed full with various articles and pieces of equipment, a car jack should also have small dimensions in order to allow it to be accommodated. It is, of course, imperative here for the reliable functioning of the car jack not to be impaired. DE 10 2004 003 177 B4 discloses a scissor car jack in which the kinematic points are connected to single-piece carrying arms. In the collapsed state, the aforementioned car jack has a maximum length which is proportional to the lifting height. In the case of the lifting heights being relatively great, this car jack is difficult to accommodate in the trunk of a passenger vehicle.

BRIEF SUMMARY OF THE INVENTION

The object of the present invention is thus to provide a scissor car jack which can be changed into a relatively small transporting volume for stowage purposes without the functional reliability being impaired.

This object is achieved by a car jack as claimed.

According to the invention, the scissor car jack has a spindle, a foot, a carrying head, a crossmember and a spindle mount with a bore with an internal thread for receiving the spindle. The foot and the carrying head are connected in a rotatable manner to the crossmember and the spindle mount by means of a respective carrying arm, wherein the carrying arms are coupled to one another in the region of the foot and of the carrying head and/or in the region of the crossmember and of the spindle mount. Furthermore, the spindle is coupled to the crossmember and the spindle mount, so that, upon rotation of the spindle, it is possible to change the distance between the spindle mount and crossmember. The carrying arms can advantageously be changed telescopically in length, so that the scissor car jack can be collapsed to a relatively small volume without impairing the functional reliability, so that the jack can be stowed in a space-saving manner in the trunk of a vehicle.

If the spindle has a pulling direction, a pushing direction and a direction of rotation along its longitudinal axis, then it is particularly advantageous if the spindle at least in the extended state, in order to be reduced in size, is not coupled to the crossmember in the pushing direction. When the telescopically changeable carrying arms are being collapsed, the spindle can thus yield in the pushing direction, so that the scissor car jack is straightforwardly reduced in volume.

It is likewise advantageous if the spindle has a length which is substantially smaller than, or equal to, double the length of a carrying arm in the collapsed state. This makes it possible to achieve a very small stowage volume for the scissor car jack since the spindle, in the collapsed state, does not project beyond the spindle mount or the crossmember.

In order to reduce the stowage volume, it is particularly advantageous if the crossmember has a guide tube for at least partially receiving the spindle, wherein the guide tube is mounted in the crossmember such that it can be rotated coaxially with the longitudinal axis of the spindle, in particular by way of a ball bearing, and the spindle can be displaced along its longitudinal axis, within the guide tube, into an operating position and a stowage position, wherein the spindle, at least in the operating position, is coupled to the guide tube in the pulling direction and the direction of rotation, so that rotation of the guide tube makes it possible to change the distance between the spindle mount and crossmember. This largely rules out the situation where the spindle projects beyond the spindle mount in the collapsed state.

In this respect, it is likewise advantageous if the spindle, in the second stowage position, does not project beyond that end of the guide tube which is directed away from the spindle, and this helps the stowage volume of the scissor car jack to be as small as possible.

The carrying arms advantageously comprise a first part and a second part which can be displaced one inside the other, so that the width of the scissor car jack can be reduced essentially by half.

In order for loads to be raised in a reliable manner, it is particularly advantageous if the carrying arms, in the extended state, can be locked in particular by means of a locking element, so that an unintended collapsing operation of the carrying arms is ruled out.

In order to ensure easy handling during locking and unlocking, it is advantageous if the locking element is a locking pin which in the extended state, in the region of overlap between the first part and the second part, these both having at least one bore in each case, can be introduced through the congruent bores, which are located one above the other, for locking purposes.

The locking pin is advantageously connected to the carrying arm by means of a flexible clip, so that, in the unlocked state, the situation where the locking pin gets lost is largely ruled out.

In order to ensure coupling of the spindle to the guide tube in the pulling direction and in the direction of rotation, it is particularly advantageous if the guide tube, with an inner radial wall and an outer radial wall, has, in the longitudinal direction, a blind hole which is provided with a polygon socket, in particular a hexagon socket, and a bore, which has a larger diameter than the spindle. In this respect, it is likewise advantageous if the spindle, at one end, has a spindle driver which connects the spindle in a rotationally fixed manner to the guide tube.

According to the invention, the scissor car jack has a spindle, spindle mount, crossmembers, ball bearing, a carrying head and a foot, wherein it is possible to displace and lock the two-part carrying arms of the scissor car jack, these carrying arms being rotatable in the foot and in the carrying head and being connected together by a pin on each side, wherein the spindle, which is provided with the spindle driver, can be displaced axially and, at the same time, is displaced automatically in the guide tube during the collapsing and extending operations. Since it is possible to collapse the spindle and the upper and lower carrying arms, the scissor car jack, in the delivery state, has a significantly smaller length and is thus easy to accommodate in the trunk of a passenger vehicle.

Advantageous embodiments of the invention are described in the dependent claims.

An exemplary embodiment of the invention is described in more detail hereinbelow and is illustrated in the drawings, in which:

BRIEF DESCRIPTION OF THE SEVERAL VIEWS OF THE DRAWING

FIG. 11 shows a view R as seen vertically on to the upper carrying-arm assembly, FIG. 12 shows a section D-D through the locking pins, FIG. 13 shows a plan view of the lower carrying-arm assembly, FIG. 14 shows a section E-E through the locking pins.

DESCRIPTION OF THE INVENTION

Figure 1:
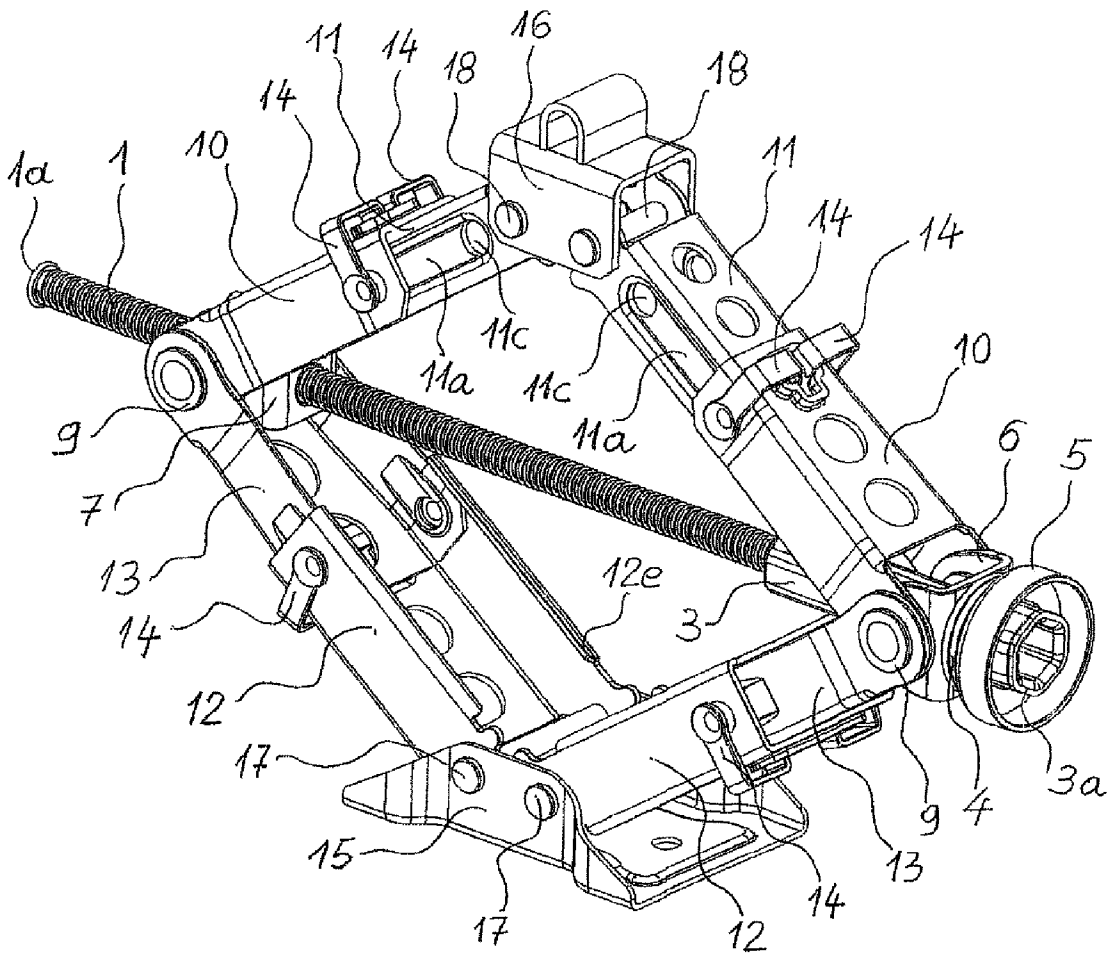
FIG. 1 shows a perspective view of a scissor car jack.
Figure 2:
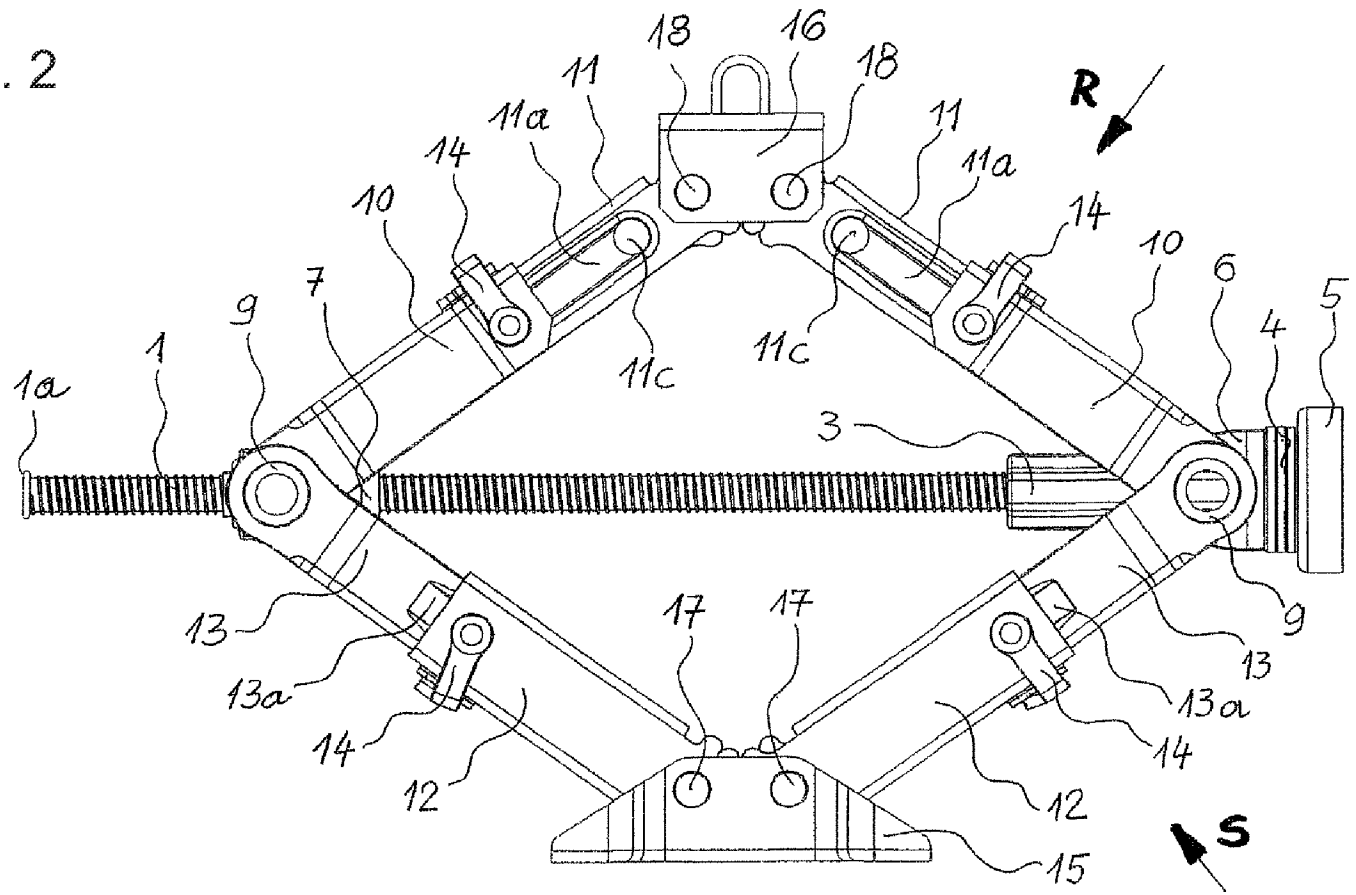
FIG. 2 shows a side view.
Figure 3:
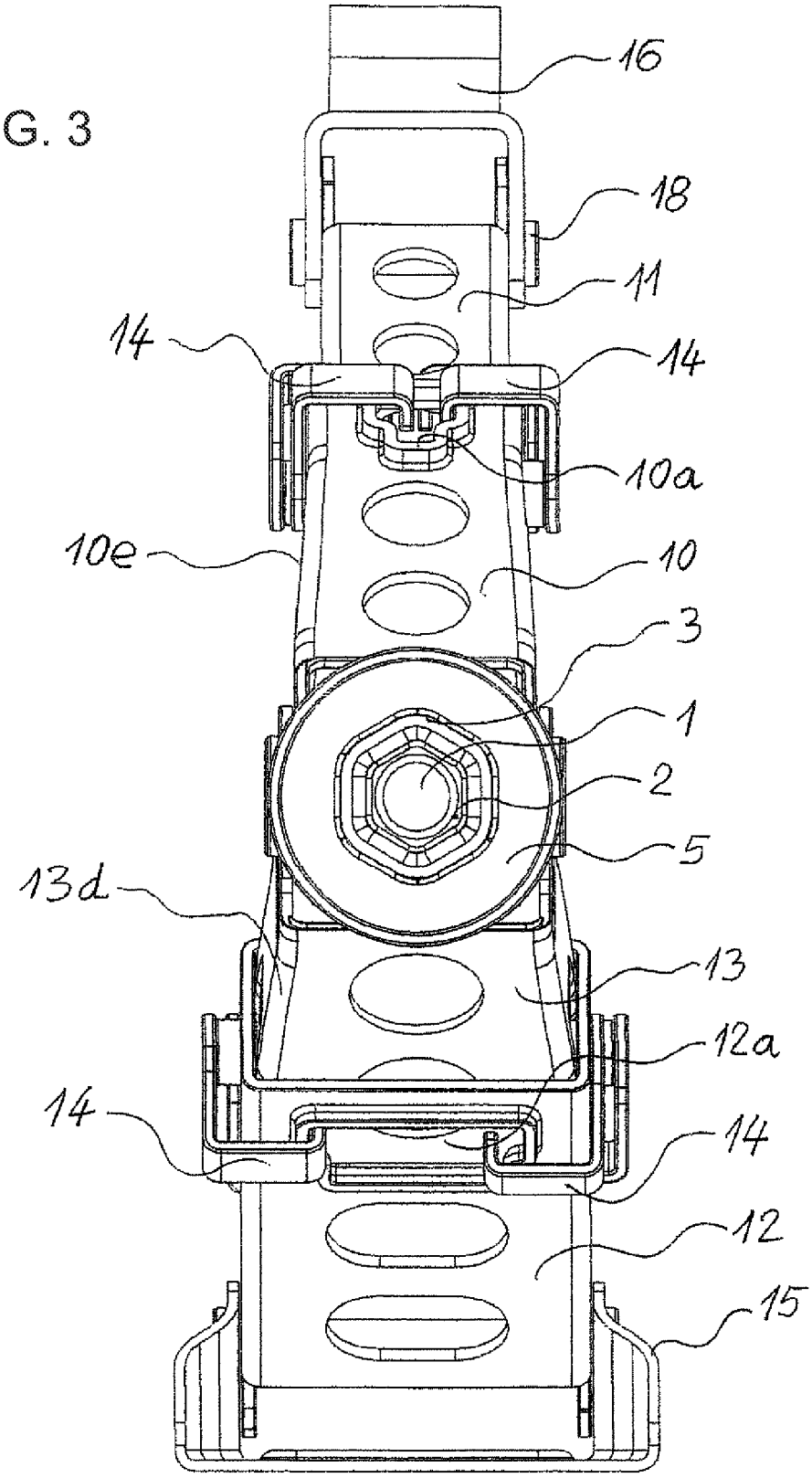
FIG. 3 shows a front view.
Figure 4:
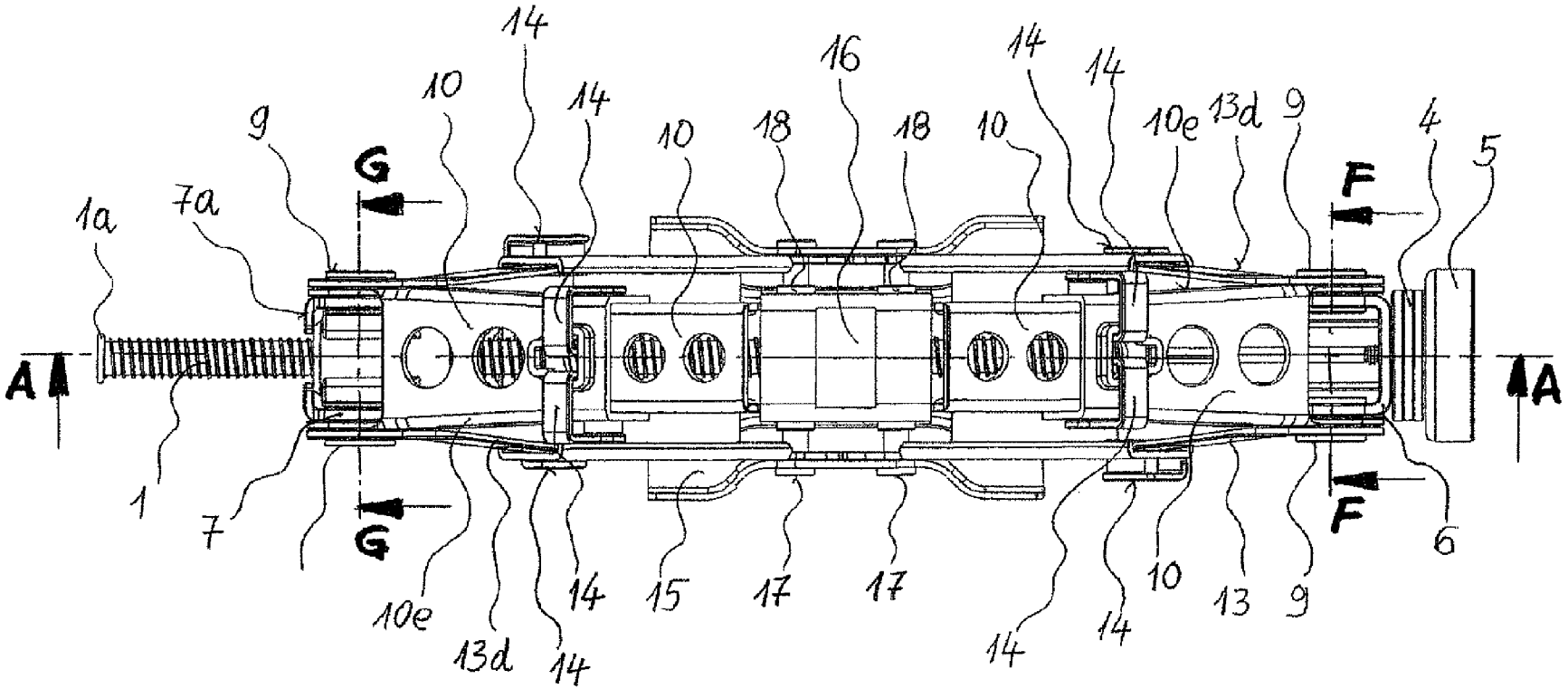
FIG. 4 shows a plan view.

Description Of A Telescopically Collapsible Scissor Car Jack

Components of a telescopically collapsible scissor car jack:

1. Spindle
1*a*. Spindle end
2. Spindle driver
3. Guide tube
3*a*. Guide-tube inner wall
3*b*. Guide-tube outer wall
3*c*. Projection
3*d*. Bore
4. Ball bearing
4*a*. Handwheel-side bearing disk
4*b*. Crossmember-side bearing disk
5. Handwheel
6. Bearing-side crossmember
7. Threaded-side crossmember
7*a*. Threaded-side crossmember end
8. Spindle mount
8*a*. Slot in the spindle mounts
9. Annular rivet with shoulder
10. Upper carrying-arm-part crossmember
10*a*. Opening for the locking pins
10*b*. Collar of the opening for the locking pins
10*c*. Bore for the locking pins
10*d*. Eyelets of the carrying arm
10*e*. Tapered formation of the upper carrying-arm crossmember
11. Carrying-arm-part carrying head
11*a*. Guiding depression
11*b*. Bore for the locking pins
11*c*. Bore for the locking pins
11*d*. Teeth of the carrying-arm carrying head
12. Carrying-arm-part foot
12*a*. Opening for the locking pins
12*b*. Collar of the opening for the locking pins
12*c*. Bore for the locking pins
12*d*. Teeth of the carrying-arm foot
13. Lower carrying-arm-part crossmember
13*a*. Guiding depression
13*b*. Bore for the locking pins
13*c*. Eyelets of the carrying arm
13*d*. Tapered formation of the lower carrying-arm crossmember
14. Locking pin
14*a*. Arm of the locking pin
15. Foot
16. Carrying head
17. Foot rivet
18. Carrying-head rivet
19. Clip
20. Rivet
21. Guiding clearance
22. Disk
23. Magnets The spindle 1 is provided with a thread and is turned to some extent at one end, so that the spindle driver 2 can be pressed or welded in. At the other end, the spindle 1 is locally pinched 1*a*. The spindle driver 2 is a disk with a central bore, which corresponds to the turned part of the spindle. The circumference of the spindle driver 2 is polygonal (e.g. a hexagon) and corresponds to the polygon socket of the guide tube 3.

The guide tube 3 is a thin-walled polygonal tube (e.g. a hexagonal tube) which, on one side, has a bore 3*d* with a radial wall 3*a* in the inward direction and, on the other side, has a radial wall 3*b* in the outward direction. The bore 3*d* is somewhat larger than the diameter of the spindle 1. The spindle driver 2 is supported on the inner radial wall 3*a*, it being possible for the spindle 1, with the spindle driver 2, to be displaced axially in the guide tube 3. Using a polygon-socket wrench (e.g. a hexagon-socket wrench), which is positioned on the other side of the guide tube 3, the torque is transmitted to the scissor car jack under load by means of a lever. The handwheel 5 is supported on the outer radial wall 3*b* of the guide tube 3. The polygonal stub of the guide tube 3 fits together with the polygon socket of the handwheel 5. This means that the torque is transmitted manually, via the handwheel 5, to the guide tube 3 and also, via the spindle driver 2, to the spindle 1. The guide tube 3 is secured against axial displacement in relation to the handwheel 5 by the outer wall 3*b* and in relation to the crossmember 6 by the projection 3*c*. The opposite side of the handwheel 5 serves as a support for the disk 4*b* of the ball bearing 4. The other disk 4*a* of the ball bearing 4 is supported on the bearing-side crossmember 6.

The upper carrying-arm assembly comprises an approximately U-shaped upper carrying-arm crossmember 10, an approximately U-shaped carrying-arm carrying head 11 and two locking pins 14, which are provided with a crosspiece arm 14*a*. The upper carrying-arm crossmember 10 has, at one end, eyelets 10*d* which coincide axially with the bores of the crossmember 6 and 7, wherein the bores 10*c* for the locking pins 14 are located laterally on limbs 10*f*. At the top, there is a T-shaped opening 10*a* with a collar 10*b* for the arm crosspieces 14*a* of the locking pins 14.

The upper carrying-arm crossmember 10 has a tapered formation 10*e* in the central region. The carrying-arm carrying head 11 fits, by way of the lower end, into the upper carrying-arm crossmember 10. Located at the upper end of the limbs are the eyelets, which are provided with teeth 11*d* and, in the center, have the bores for the carrying-head rivets 18. Located laterally on the limb of the carrying-arm carrying head 11 are shallow guiding depressions 11*a*, which are of a width which is approximately equal to the diameter of the locking pins 14. In addition, in each limb, there is a bore lib for the locking pins in the extended state and a bore 11*c* for the locking pins in the collapsed state. These bores lib and 11*c* of the carrying-arm carrying head 11 coincide axially with the bores 10*c* of the upper carrying-arm crossmember 10.

The arm crosspieces 14*a* of the locking pins 14 are angled into the T-shaped opening 10*a* of the upper carrying-arm crossmember 10, so that the locking pins 14 can be displaced axially and are secured against sliding away. As soon as the locking pins 14 have been pushed all the way in they arrest the bores 10*c* in the upper carrying-arm crossmember 10 and the bores lib in the carrying-arm carrying head 11 and thus allow forces to flow between the two carrying-arm parts 10 and 11. The locking pins 14 can also be rotated in the T-shaped opening 10*a*, so that it is possible to lock the upper carrying-arm crossmember 10 and the carrying-arm carrying head 11 during the operating cycles. Locking pins 14 which have been displaced axially outward no longer arrest the bores 11*b* of the carrying-arm carrying head 11, and it is possible to collapse the two carrying-arm parts 10 and 11. The two bores of the upper carrying-arm crossmember then fit axially onto the bores 11*c*, so that it is possible to lock the two carrying arms 10 and 11 in the collapsed state. For this purpose, the locking pins 14 have to be forced together and thus pushed axially inward. They are then rotated in the T-shaped opening 10*a* (section D-D).

The lower carrying-arm assembly comprises an approximately U-shaped carrying-arm foot 12, an approximately U-shaped lower carrying-arm crossmember 13 and two locking pins 14, which are provided with a crosspiece arm 14. Located at the lower end of the limbs of the carrying-arm foot 12 are the eyelets, which are provided with teeth 12*d* and, in the center, have the bores for the foot rivets 17. The bores 12*c* for the locking pins 14 are located laterally on the limbs of the carrying-arm foot 12 and, at the top, there is a T-shaped opening 12*a* with a collar 12*b* for the angled arm crosspieces 14*a* of the locking pins 14. The lower carrying-arm-part crossmember 13 fits, by way of the lower end, into the carrying-arm foot 12, wherein the eyelets 13*c* are located on the limbs, and these eyelets coincide axially with the bores of the crossmembers 6 and 7. Located laterally on the limb of the lower carrying-arm-part crossmember 13 are shallow guiding depressions 13*a*, which are of a width which is approximately equal to the diameter of the locking pins 14. A respective bore 13*b* is located on the limb, on each side, for the locking pins 14 in the extended state. These bores 13*b* of the lower carrying-arm-part crossmember 13 coincide axially with the bores 12*c* of the carrying-arm-part foot 12. The crosspiece arms 14*a* of the locking pins 14 are angled into the T-shaped depression 12*a* of the carrying-arm-part foot 12, so that the locking pins 14 can be displaced axially and are secured against sliding away. As soon as the locking pins 14 have been pushed all the way in, they arrest the bores 13*b* and 12*c* in the lower carrying-arm crossmember 13 and carrying-arm foot 12 and thus allow forces to flow between the two carrying-arm parts 12 and 13. The locking pins 14 can also be rotated in the T-shaped opening 12*a*, so that it is possible to lock the lower carrying-arm crossmember 13 and the carrying-arm foot 12 during the operating cycles. Locking pins 14 which have been displaced axially outward no longer arrest the bores 13*b* of the lower carrying-arm crossmember 13, and it is possible to collapse the two carrying-arm parts 12 and 13. The lower carrying-arm crossmember 13 has a tapered formation 13*d* in the central region. This tapered formation 13*s* means that the guiding depressions 13*a* in the lower carrying-arm crossmember 13 are incomplete. This means that, during the displacement of the carrying-arm parts 12 and 13, the locking pins 14 are not guided to the full extent in the lower carrying-arm crossmember 13. In order to prevent the carrying-arm parts 12 and 13 from falling out, the limbs of the carrying-arm-part foot 12 are angled inward approximately at right angles 12*e*, and this ensures full guidance for the carrying-arm-part foot 12 and lower carrying-arm crossmember 13 during the displacement (see section E-E). In the collapsed state, the car jack is already locked by the locking pins 14 in the upper carrying-arm assembly.

Figure 10:
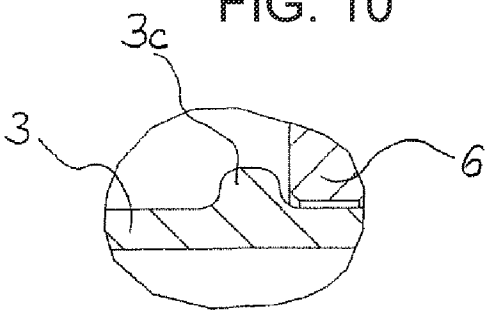
FIG. 10 shows a detail U of the guide tube.
Figure 9:
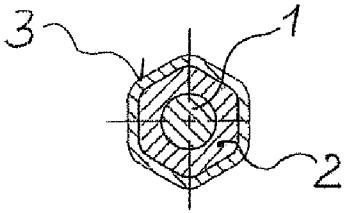
FIG. 9 shows a section C-C through the spindle driver.
Figure 8:
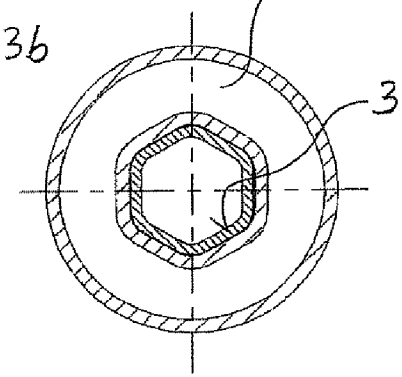
FIG. 8 shows a section B-B through the handwheel.
Figure 7:
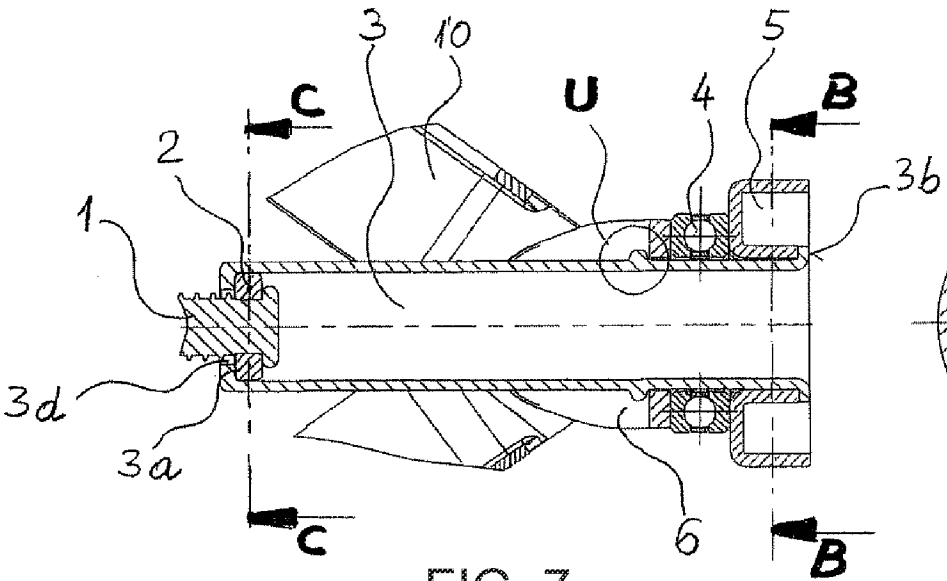
FIG. 7 shows a partial section of the bearing-side crossmember.
Figure 16:
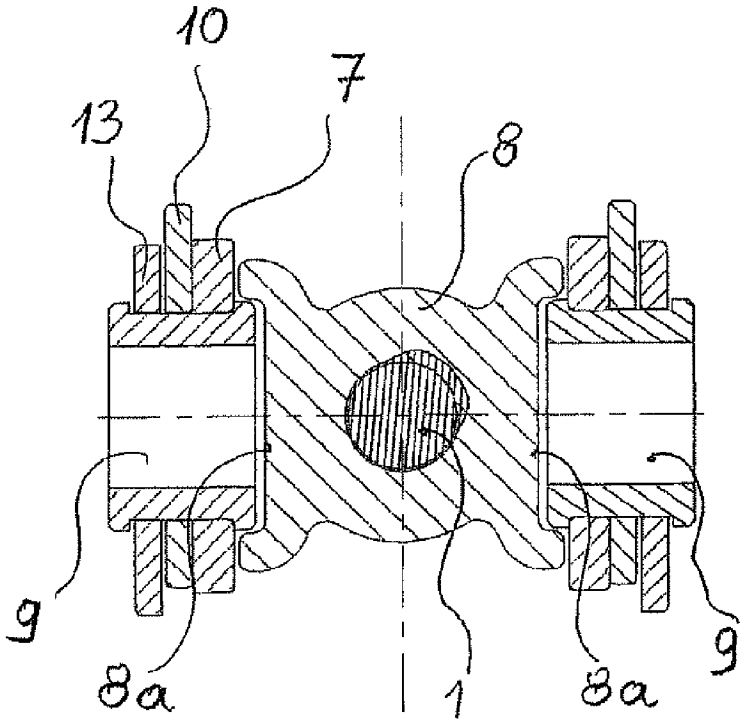
FIG. 16 shows a section G-G through the threaded-side crossmember.
Figure 15:
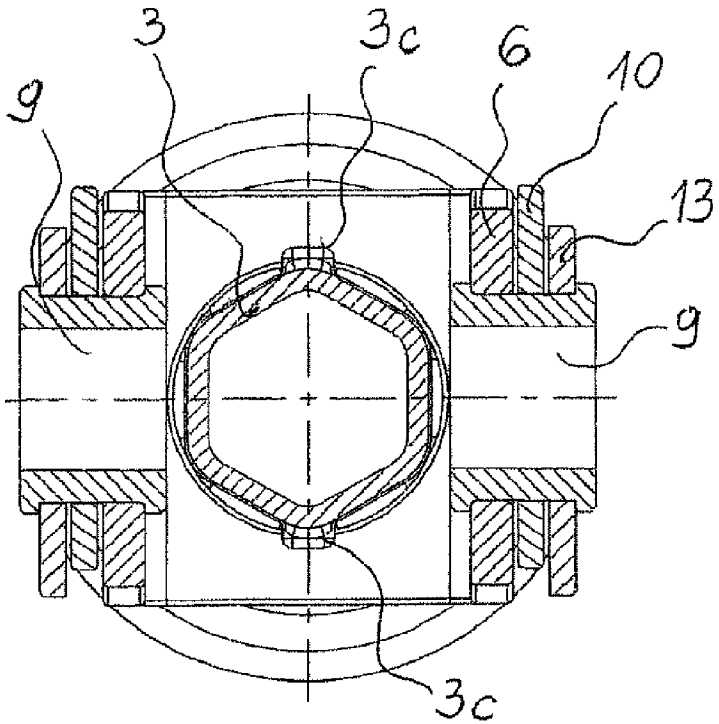
FIG. 15 shows a section F-F through the bearing-side crossmember.
Figure 17:
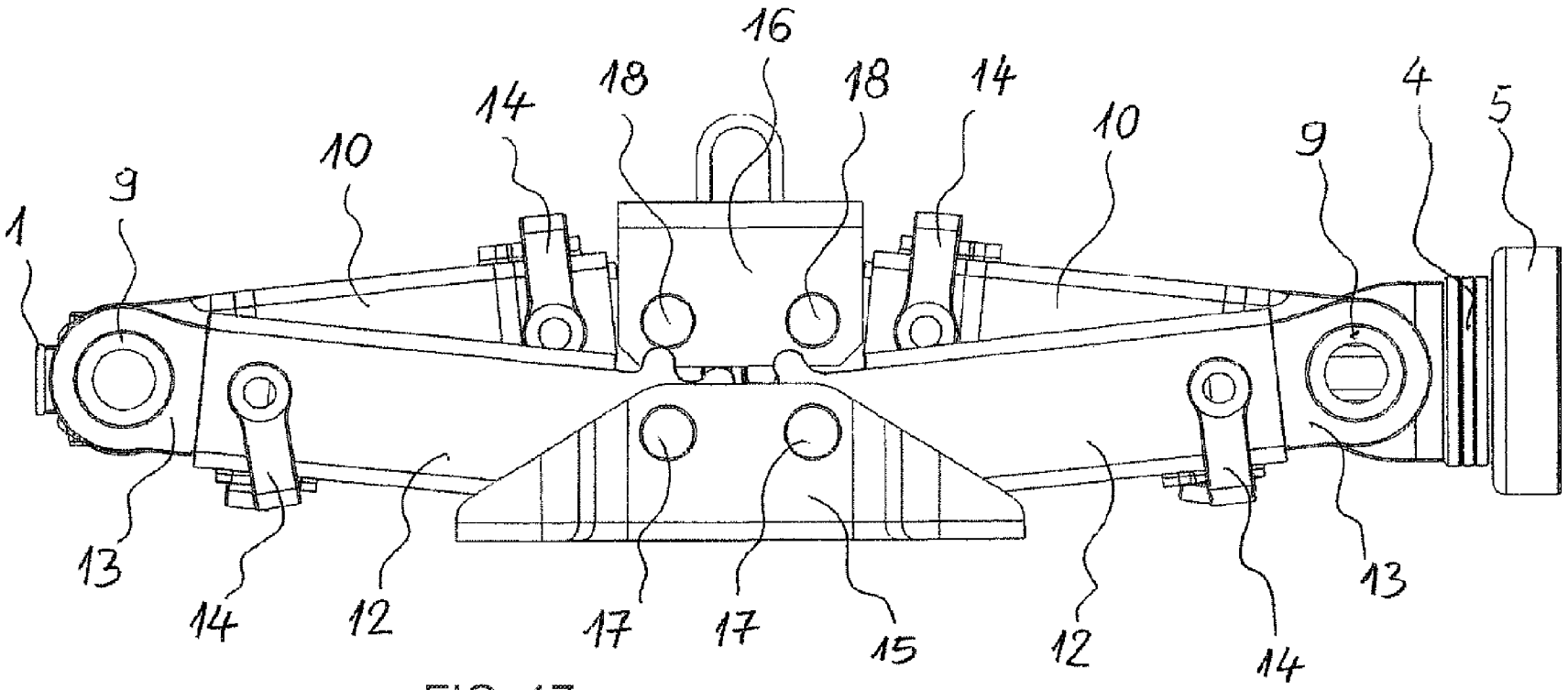
FIG. 17 shows a side view in the collapsed state.
Figure 18:
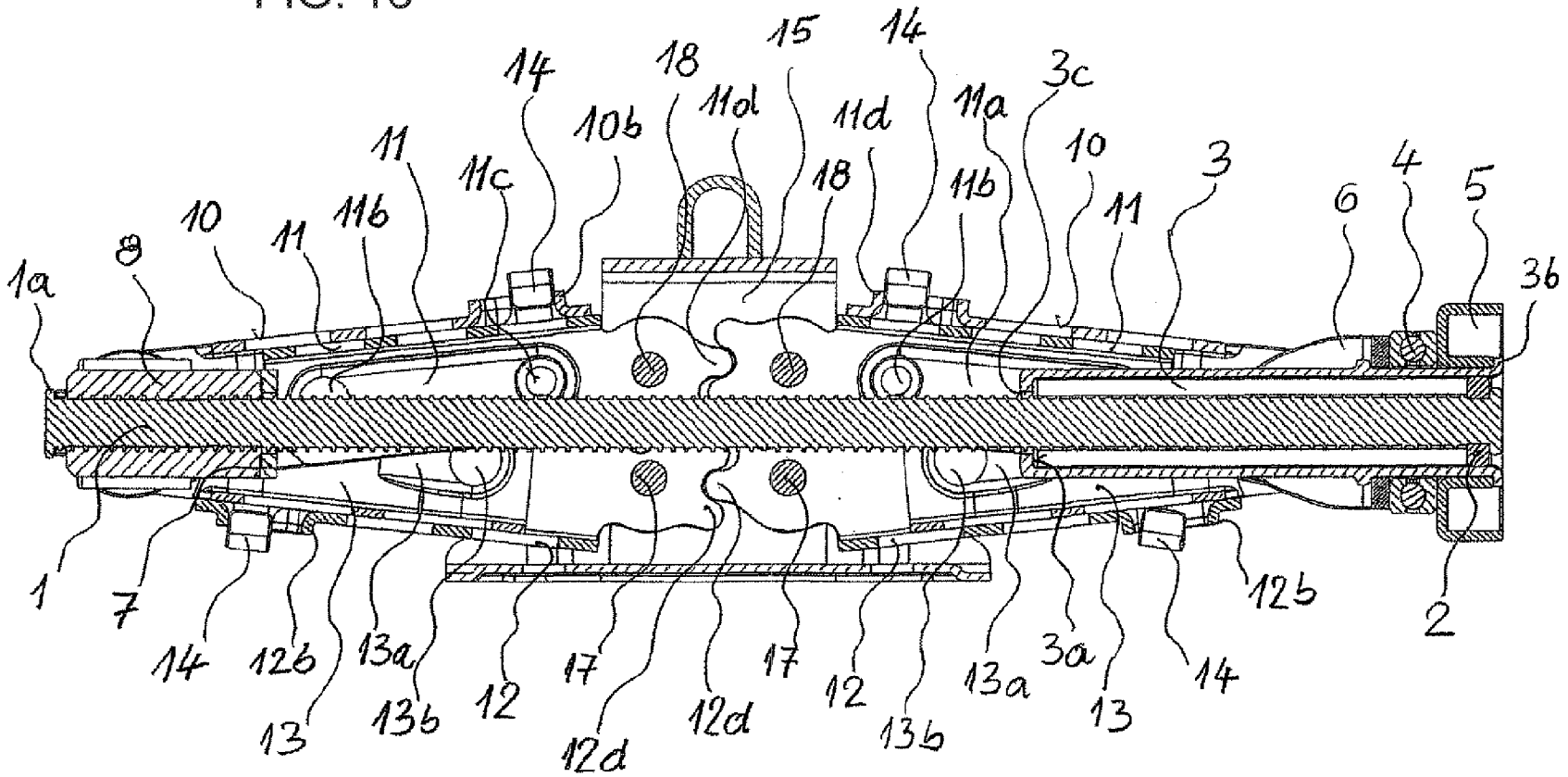
FIG. 18 shows a section A-A in the collapsed state.
Figure 19:
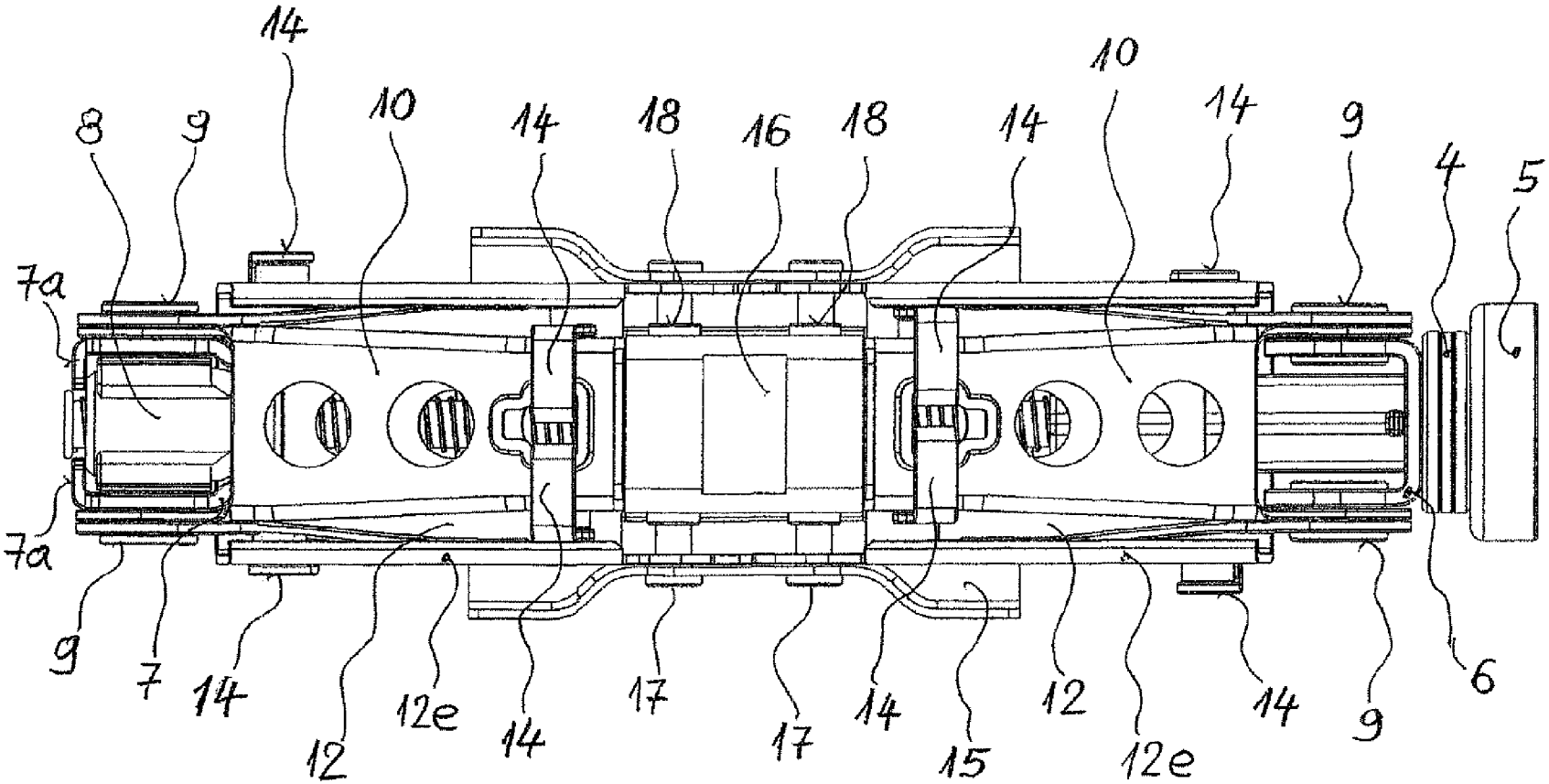
FIG. 19 shows a plan view of the scissor car jack in the collapsed state.
Figure 20:
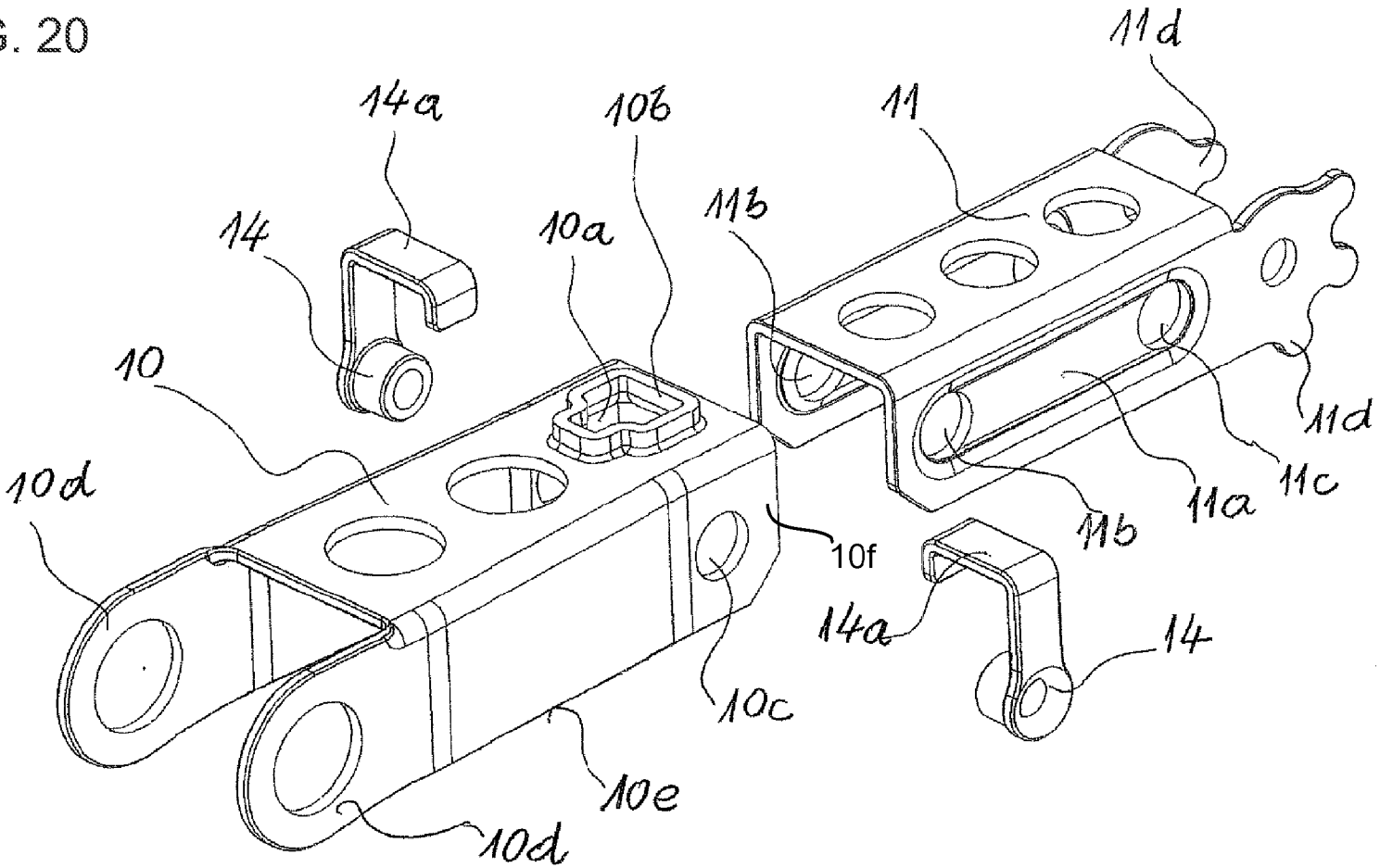
FIG. 20 shows an exploded illustration of the upper carrying-arm crossmember and carrying-arm carrying head.
Figure 21:
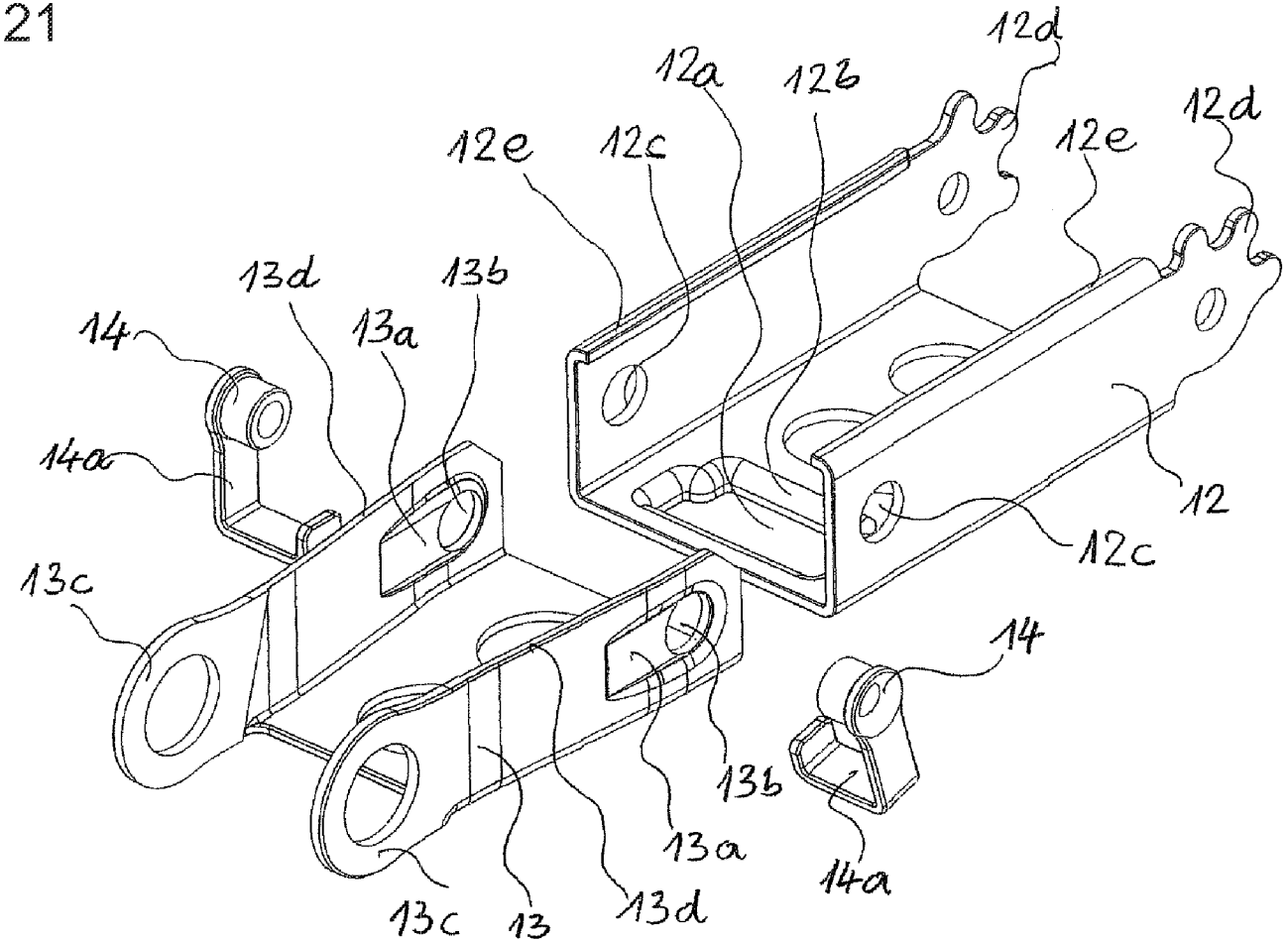
FIG. 21 shows an exploded illustration of the carrying-arm foot and lower carrying-arm crossmember.
Figure 22:
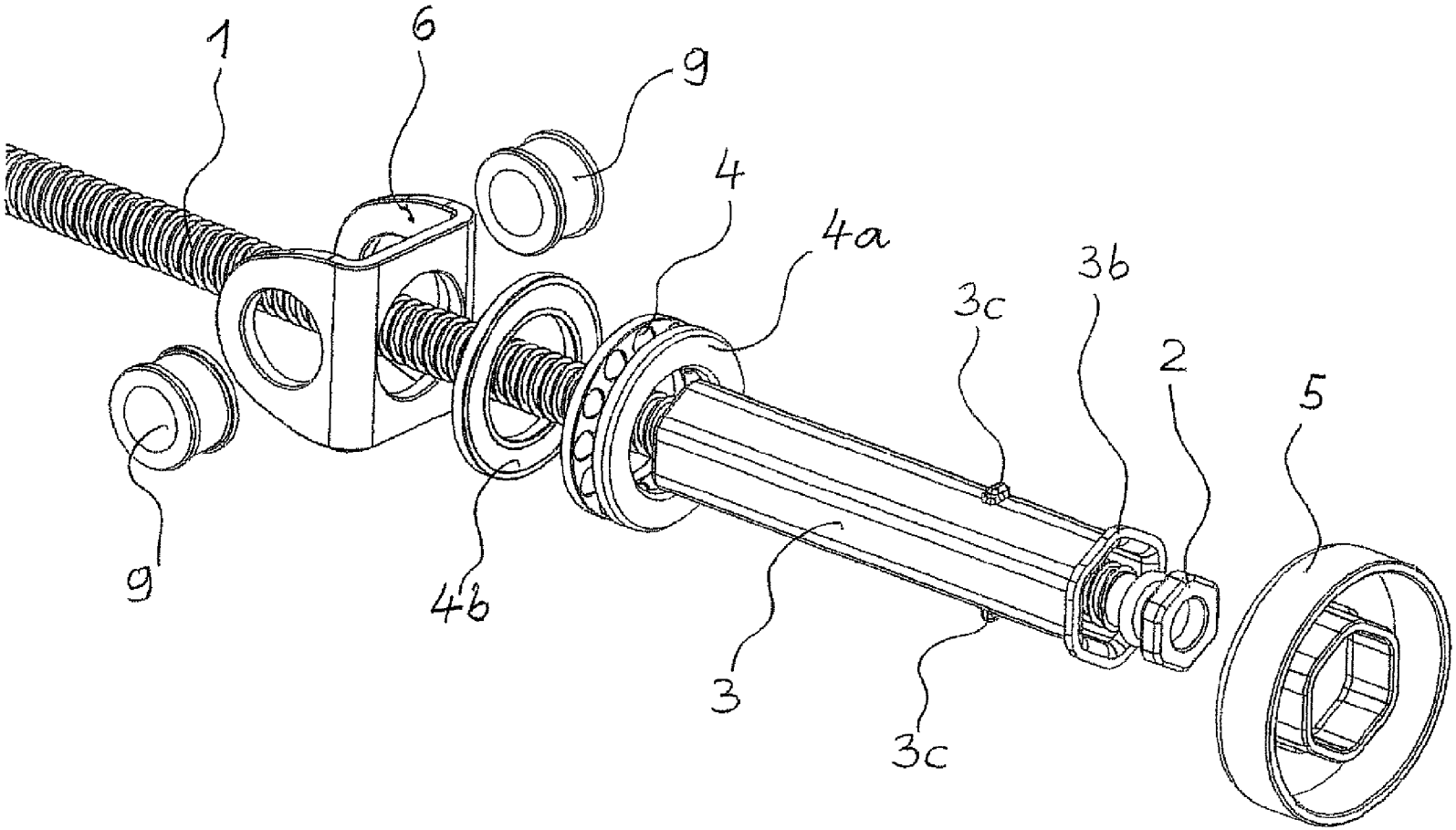
FIG. 22 shows an exploded illustration of the bearing-side crossmember.
Figure 23:
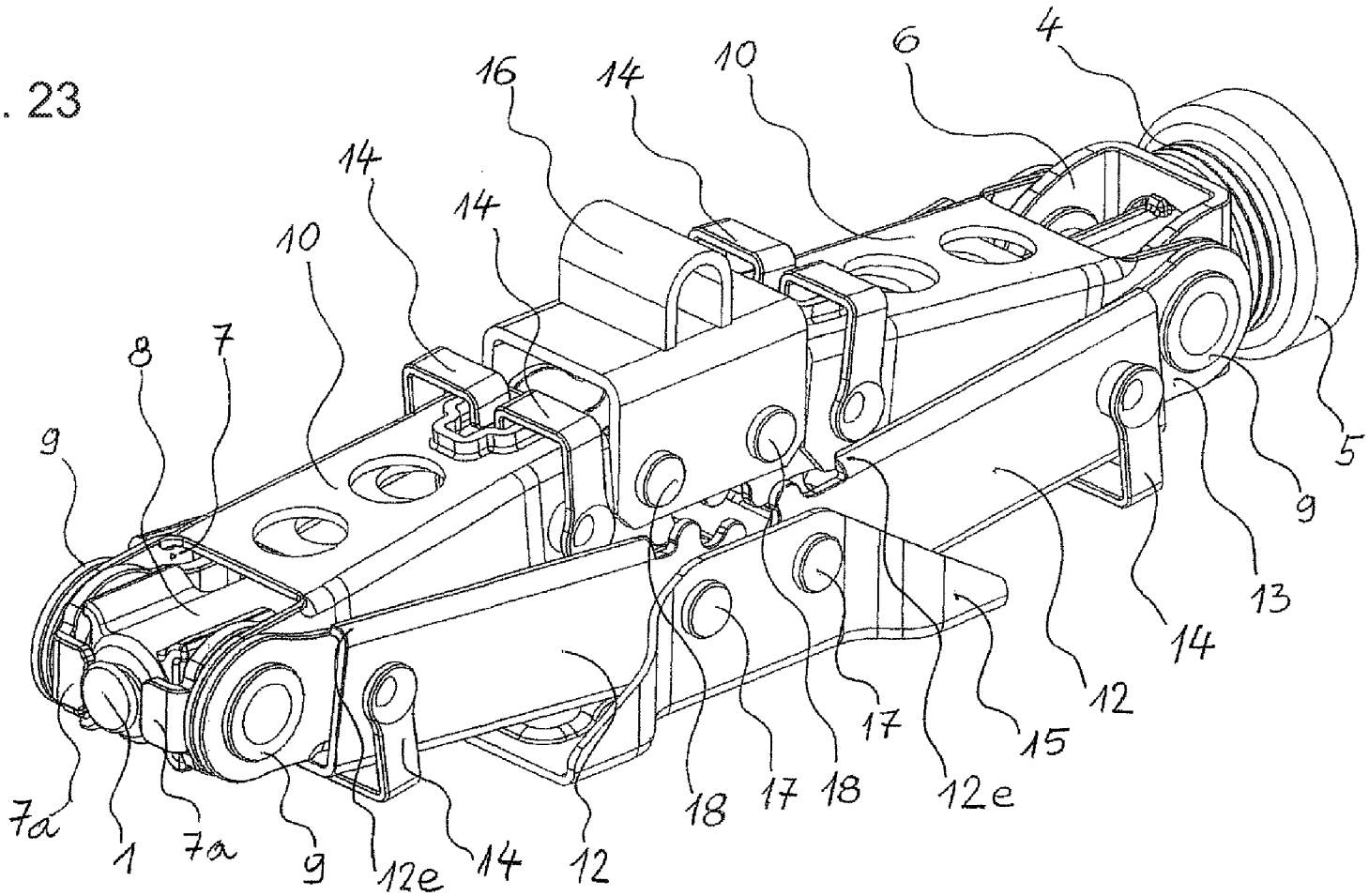
FIG. 23 shows a perspective view of the car jack in the collapsed state.
Figure 24:
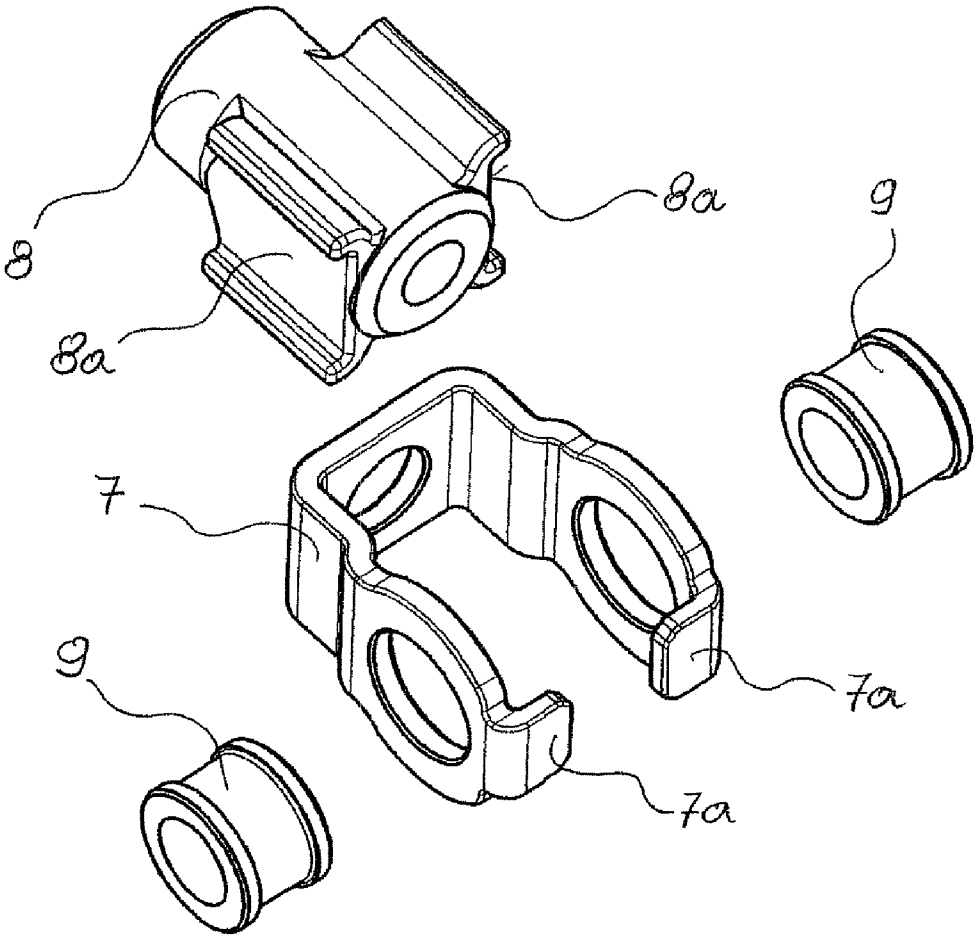
FIG. 24 shows an exploded illustration of the threaded-side crossmember.

The bearing-side crossmember 6 is U-shaped, with a bore in the center and two bores on the limbs. Once the upper carrying-arm assembly and the lower carrying-arm assembly has been positioned along the axis of the bores of the bearing-side crossmember 6, the annular rivets 9 are pushed in and pressed against the eyelets 10*d* and 13*c* of the carrying arms 10 and 13 (see section F-F). The guide-tube assembly is then pushed into the central bore of the bearing-side crossmember 6 and locally deformed to a slight extent 3*c*, using a pressing tool, so that it cannot slide (see FIG. 10). This means that the guide tube 3 can be rotated in the bearing-side crossmember 6 and is secured axially against sliding. The upper carrying-arm assembly and the lower carrying-arm assembly can be rotated about the axis of the bearing-side crossmember 6 and are secured axially against sliding.

The threaded-side crossmember 7 is of U-shaped configuration, with a bore in the center and two bores on the limbs. Once the upper carrying-arm assembly and the lower carrying-arm assembly have been positioned along the axis of the bores of the threaded-side crossmember 7, the annular rivets 9 are pushed in and pressed against the eyelets 10*d* and 13*c* of the carrying arms 10 and 13 (see section G-G). The spindle mount 8, which has a respective slot 8*a* for the annular rivet 9 on each side, is then pushed in and the threaded-side crossmember ends 7*a* are angled approximately at right angles, so that the spindle mount is secured in the axial and radial directions. The upper carrying-arm assembly and the lower carrying-arm assembly can thus be rotated about the axis of the threaded-side crossmember and are secured axially against sliding.

The bearing-side crossmember 6 with the upper carrying-arm assembly and the lower carrying-arm assembly and also the threaded-side crossmember 7 with the upper carrying-arm assembly and the lower carrying-arm assembly are connected in a rotatable manner to the foot 15 at the bottom and to the carrying head 16 at the top by foot rivets 17 and carrying-head rivets 18.

Figures 5, 6:
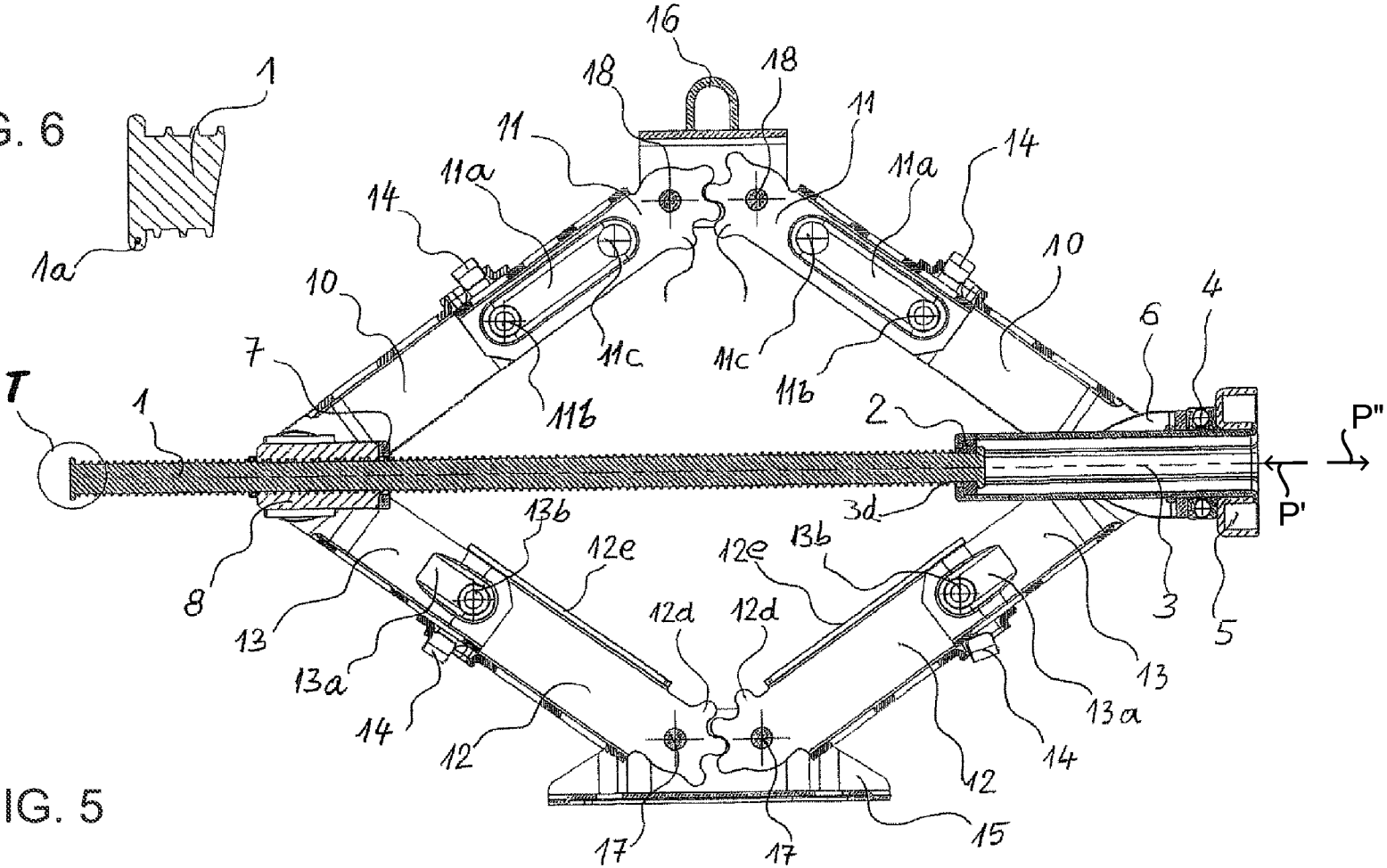
FIG. 5 shows a section A-A.
FIG. 6 shows a detail T of the spindle end.

With the scissor car jack at a minimal height, the spindle 1 is pushed, by way of the spindle driver 2, through the guide tube 3 in a pushing direction P' (FIG. 5) and by rotation of the guide tube 3, via the spindle driver 2, is screwed into the spindle mount 8 until the spindle driver 2 rests against the inner radial wall 3*a* of the guide tube 3. A pressing tool is then used to deform the spindle end 1*a* outside the spindle mount so that it cannot be unscrewed.

The ready assembled car jack is raised and lowered by virtue of the spindle 1 being rotated by means of a crank, in particular a polygon-socket wrench, which fits into the end of the guide tube 3, or by means of the handwheel 5. If the car jack is placed under the load, the force on the carrying head 16 is transmitted to the foot 15 via the eyelets 10*d* and 13*c* of the carrying arms 10 and 13. The other force component acts axially on the spindle mount 8 via the guide tube 3, the spindle driver 2 and the spindle 1 in a pulling direction P", opposing the pushing direction P' (FIG. 5) of the car jack. By virtue of the guide tube 3 being rotated via the spindle driver 2, and thus also the spindle 1 in the spindle mount 8, the two cross-members 6 and 7 with the upper carrying-arm assembly and the lower carrying-arm assembly are joined together and the car jack raises the load.

In order to make it possible for the car jack to have a small length in the packed state, this being the actual object of the invention, the telescopically collapsible scissor car jack can be collapsed.

The lowest height of the car jack is set by virtue of the guide tube 3 being rotated by means of the handwheel 5 or of a torque wrench with a hexagon socket. All the locking pins 14 are then pulled outward, as a result of which it is possible to collapse the entire upper carrying-arm assembly and the entire lower carrying-arm assembly. At the same time, the spindle 1, with the spindle driver 2, is automatically collapsed by the same distance and, at the same time, reaches the end of the guide tube 3. The locking pins 14 in the upper carrying-arm assembly are then forced together and rotated in the T-shaped opening 10*a*, in order to lock the car jack in the packed state. This makes it possible to achieve a substantially smaller length for the telescopically collapsible scissor car jack in the packed state.

In order to render the scissor car jack operational again, the locking pins 14 have to be drawn out and the upper carrying-arm assembly and the lower carrying-arm assembly have to be extended. At the same time, the spindle 1 is also automatically pulled in the guide tube 3 by way of the spindle driver 2 and positioned against the inner radial wall 3*a* of the guide tube 3. The locking pins 14 are forced together again in the T-shaped opening 10*a* and 13*a*, and the locking pins 14 are then rotated and the scissor car jack is thus locked. The telescopically collapsible scissor car jack is then ready for operation again.

Figure 25:
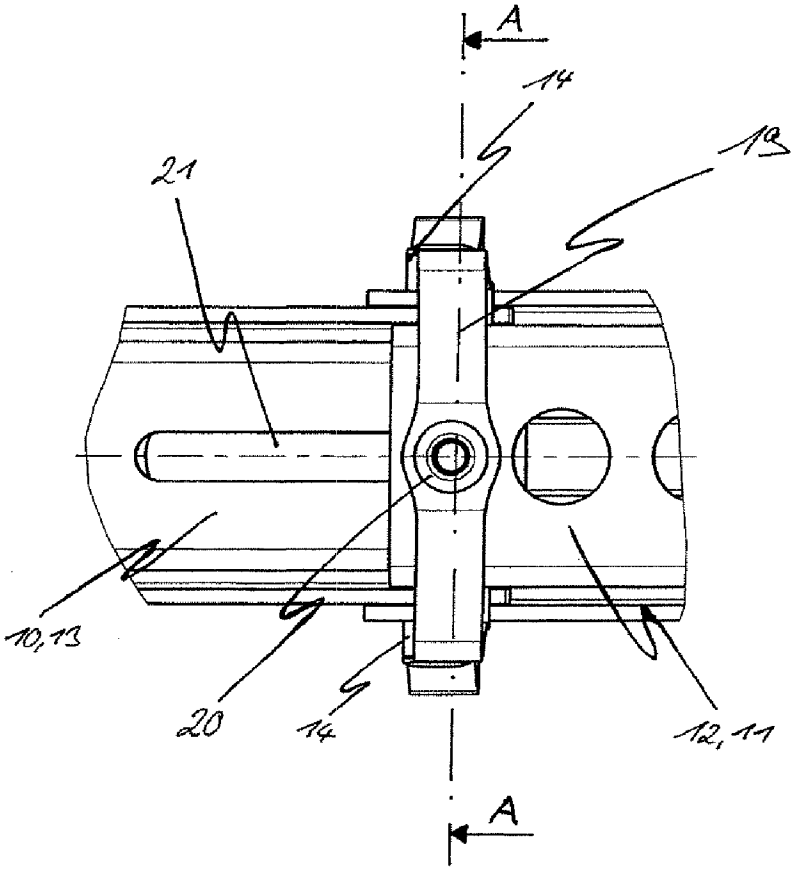
FIG. 25 shows a plan view and a section of an alternative locking element.
Figure 25:
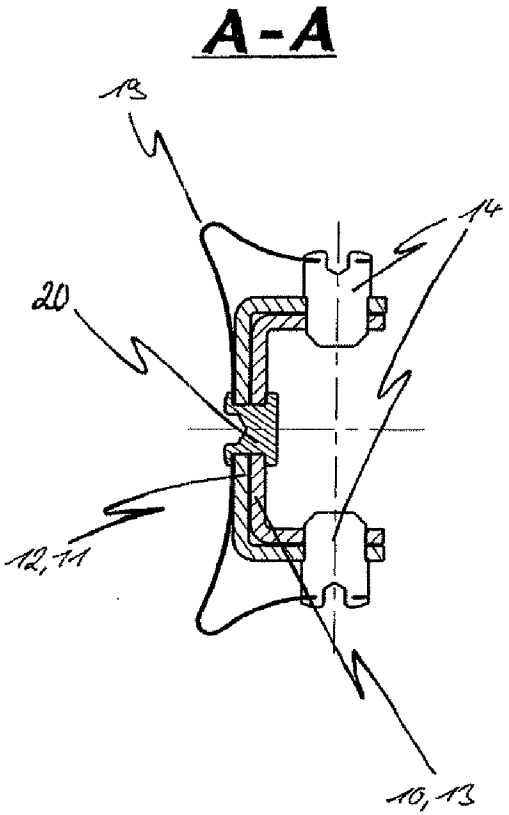
Figure 26:
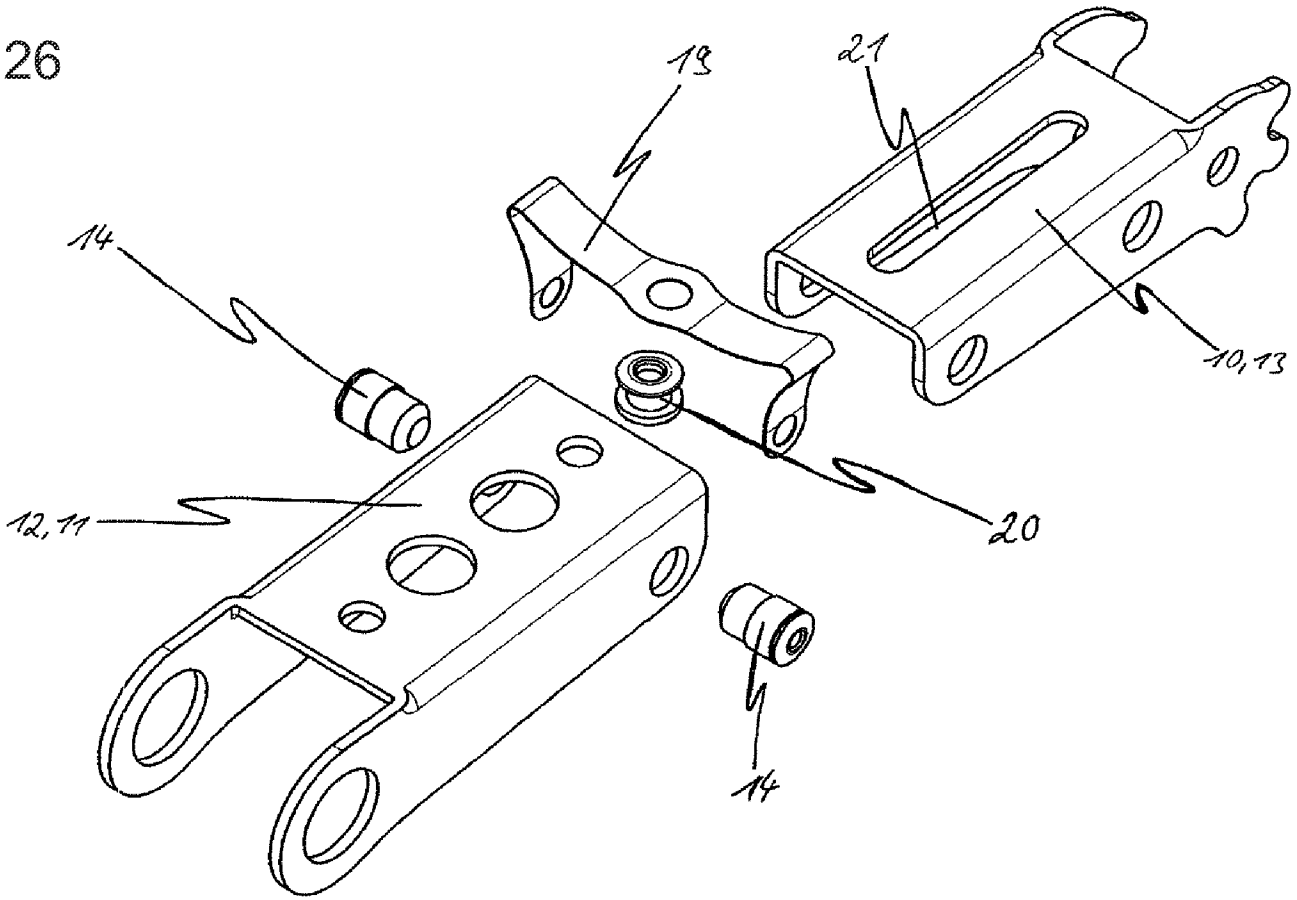
FIG. 26 shows an exploded illustration of an alternative locking element.

An alternative embodiment of the locking elements can be found in FIGS. 25 and 26. The locking pins 14 are riveted to a clip 19 to form a subassembly, which is then riveted together with the two carrying arms 10, 13 and 11, 12. The assembly can thus advantageously replace that between the locking pins 14 and crosspiece arms 14*a*. The carrying arms 10, 13 and 11, 12 are guided, during displacement, by a rivet 20 in the center of the clip 19, as a result of which the lateral depressions 11*a*, 13*a* are dispensed with. It is likewise the case that the collars 10*b*, 12*b* on the carrying arms 10, 12 are no longer necessary. The carrying-arm carrying head 11 and lower carrying-arm eyelet 13 are provided with guiding clearances 21. The lower carrying-arm eyelet 13 is provided with two holes in the region of the eyelet, so that it is also possible to arrest the locking pins 14 at the bottom in the collapsed state. Rather than the upper carrying-arm eyelet 10 and lower carrying-arm eyelet 13 being conical, they now have parallel sides. It is thus possible to arrest the locking pins 14 in the collapsed state.

Figure 29:
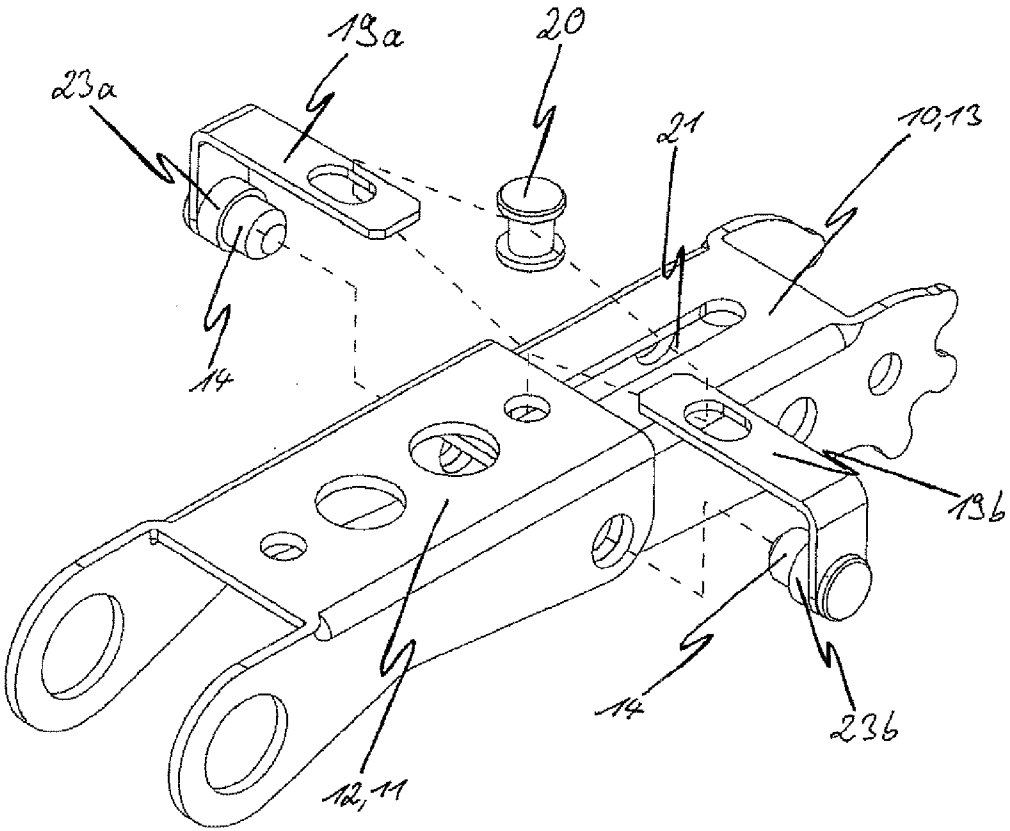
FIG. 29 shows an exploded illustration of an alternative locking element.
Figure 28:
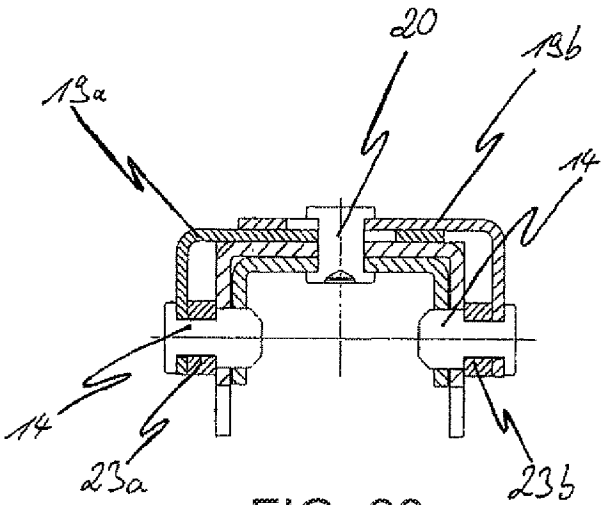
FIG. 28 shows a section through an alternative locking element.

A further alternative embodiment of the locking elements can be found in FIGS. 28 and 29. In this alternative embodiment, the clip 19*a*, 19*b* is in two pieces. Furthermore, the clips 19*a*, 19*b* are rigid, so that the locking pins 14 are guided in a translatory manner during locking and unlocking. The locking pins 14 additionally have magnets 23*a*, 23*b*, which are attracted magnetically by the carrying arms 12, 11, so that the situation where the carrying arms 12, 11, 10, 13 are unlocked accidentally, and the locking pins 14 get lost, is largely ruled out.

Figure 27:
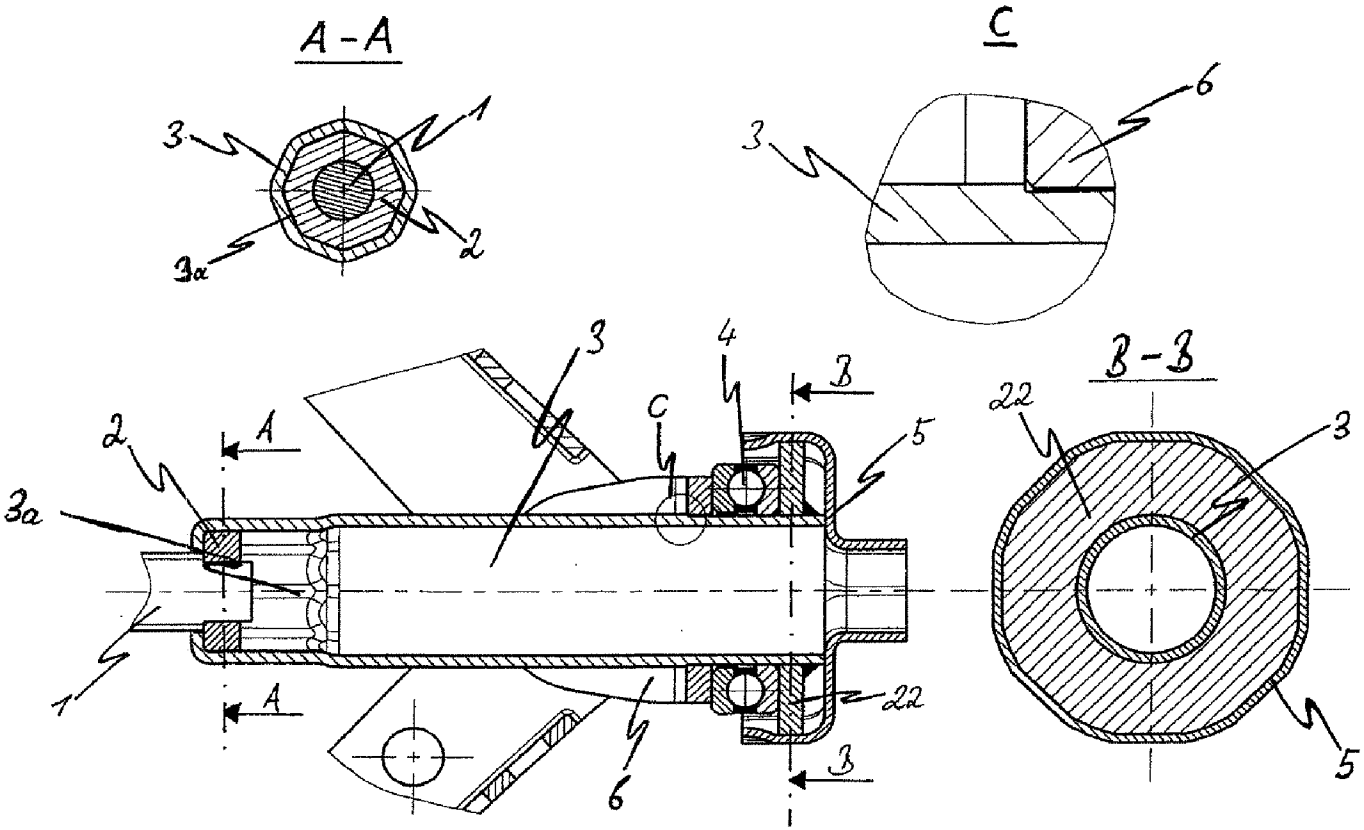
FIG. 27 shows sections through an alternative guide tube.

An alternative embodiment of the guide tube can be found in FIG. 27. The guide tube 3 is polygonal in the region of the inner wall 3*a* and round in the region of the bearing-side crossmember 6. The guide tube 3 has a somewhat smaller diameter in the region of the bearing-side crossmember 6, so that the bearing-side crossmember 6 can be supported and the pinched formation 3*c* is dispensed with. The outer wall 3*b* is dispensed with and replaced by a disk 22, which is polygonal around the circumference and has a round bore on the inside. It is welded onto the guide tube 3 once the bearing-side crossmember 6, the collar sleeves and the ball bearing 4 has been fitted. The annular rivets are replaced by the collar sleeves, since there is no need for any deformation of the sleeve once the guide tube 3 has been fitted in the bearing-side crossmember 6. The collar sleeves are thus blocked, and only minimal axial movement in relation to the guide tube 3 is then possible, as a result of which the guide tube 3 can rotate without obstruction. The spindle 1 is inserted into the guide tube 3 by way of the spindle driver 2, screwed into the spindle mount 8, in particular a plastics-material nut, and is then pinched to some extent 1*a* at the end. The handwheel 5, which is polygonal around the circumference, in order to allow torque transmission, is fitted onto the disk and then pinched to some extent. As an alternative, it is also conceivable for the plastics-material nut 8 and the collar sleeves 9 to be fixed by a locking plate. The handwheel 5, on the other side, has a hexagonal formation for the wheel wrench, which can be used to raise the car jack by virtue of the handwheel 5 being rotated.

The invention is not restricted to the exemplary embodiments illustrated. Combining the car-jack components which have been illustrated, described or are possible with other components is always possible within the context of the claims and the rest of the disclosure.

The invention claimed is:

1. A scissor jack, comprising:

a spindle, a foot, a carrying head, a crossmember, and a spindle mount formed with a threaded bore for receiving said spindle;

carrying arms pivotally connecting said foot and said carrying head to said crossmember and to said spindle mount;

said carrying arms being coupled to one another at one or both of said foot and said carrying head or said crossmember and said spindle mount, and said carrying arms being telescopic arms having a telescopically variable length; and said spindle being coupled to said crossmember and said spindle mount such that a rotation of said spindle causes a change in a spacing distance between said spindle mount and said crossmember.

2. The scissor jack according to claim 1, wherein said spindle has a longitudinal axis along which said spindle has a pulling direction, a pushing direction, and an axis of rotation and, in an extended state, is not affixed to the crossmember in the pushing direction, so that said spindle can be displaced automatically in the pushing direction during a collapsing operation.

3. The scissor jack according to claim 1, wherein said spindle has a length substantially less or equal to twice a length of a carrying arm in a telescopically collapsed state.

4. The scissor jack according to claim 1, wherein said cross-member has a guide tube for at least partially receiving said spindle, wherein said guide tube is mounted in said crossmember for rotation coaxially with said spindle, and said spindle is displaceable along the longitudinal axis, within said guide tube, between an operating position and a stowage position, wherein said spindle, at least in the operating position, is coupled to said guide tube in the pulling direction and the direction of rotation, such that a rotation of said guide tube renders possible a change in the spacing distance between said spindle mount and said crossmember.

5. The scissor jack according to claim 4, which comprises a ball bearing rotatably mounting said guide tube in said crossmember.

6. The scissor jack according to claim 4, wherein said spindle, in the stowage position, does not project beyond an end of said guide tube distal from said spindle.

7. The scissor jack according to claim 1, wherein said carrying arms comprise a first part and a second part and wherein said first and second parts are displaceable one inside the other.

8. The scissor jack according to claim 7, which comprises a locking element disposed to lock said carrying arms in an extended state thereof.

9. The scissor jack according to claim 8, wherein said locking element is a locking pin, said first and second parts are each formed with at least one bore, and said locking pin, in the extended state of the respective said carrying arm is inserted into said bores congruently placed in a region of overlap between said first and second parts.

10. The scissor jack according to claim 9, wherein said locking pin is connected to the respective said carrying arm by way of a clip.

11. The scissor jack according to claim 10, wherein said clip is flexible to avoid said locking pin from getting lost.

12. The scissor jack according to claim 4, wherein said guide tube, with an inner radial wall and an outer radial wall, is formed with a blind hole in a longitudinal direction, said blind hole being provided with a polygonal socket and a bore having a greater diameter than said spindle.

13. The scissor jack according to claim 12, wherein said spindle has an end with a spindle driver coupling said spindle to said guide tube, at least in the operating position, in a direction of rotation and a pulling direction.

14. The scissor jack according to claim 13, wherein said spindle driver is a polygonal stub disposed to interact with said polygonal socket of said guide tube.

15. The scissor jack according to claim 4, which comprises a handwheel connected in a rotationally fixed relationship with said guide tube, and supported on an outer radial wall of said guide tube and on a disk of a ball bearing rotatably mounting said guide tube in said crossmember.

16. The scissor jack according to claim 15, wherein said guide tube has a polygonal stub and said handwheel is seated on said polygonal stub by way of a polygon socket.

17. The scissor jack according to claim 1, wherein said carrying arms include an upper carrying arm assembly having an approximately U-shaped upper carrying arm-part crossmember, an approximately U-shaped carrying-arm-part carrying head and two axially displaceable and rotatable locking pins, and wherein said carrying-arm-part carrying head can be displaced into said upper carrying-arm-part crossmember.

18. The scissor jack according to claim 17, wherein said carrying arms further include a lower carrying arm assembly having an approximately U-shaped carrying-arm-part foot, an approximately U-shaped lower carrying-arm-part crossmember and two axially displaceable and rotatable locking pins, and wherein said lower carrying-arm-part crossmember can be displaced into said carrying-arm-part foot.

19. The scissor jack according to claim 18, wherein at least one of said upper carrying-arm-part crossmember or said carrying-arm-part foot has a central surface, limbs and, at one end thereof, eyelets and wherein a bore is formed on said limbs and a T-shaped opening is formed on said central surface.

20. The scissor jack according to claim 18, wherein at least one of said carrying-arm-part carrying head or said lower carrying-arm-part crossmember has limbs and, at one end thereof, eyelets with teeth, and wherein shallow guiding depressions with bores are disposed on said limbs.

21. The scissor jack according to claim 19, wherein said locking pin has a crosspiece arm engaging in said T-shaped opening.

22. The scissor jack according to claim 19, wherein said guide tube has a projection in a region of said crossmember.

23. The scissor jack according to claim 19, wherein at least one of said upper carrying-arm-part crossmember or said lower carrying-arm-part crossmember has a tapered formation.

24. The scissor jack according to claim 19, wherein said limbs of said carrying-arm-part foot are angled inwards approximately at right angles.

25. The scissor jack according to claim 19, wherein said T-shaped opening is formed with a collar.

26. The scissor jack according to claim 1, wherein a spindle is a threaded spindle and an end of the threaded side is formed with a pinched portion to avoid unscrewing of said spindle from said spindle mount.

27. The scissor jack according to claim 1, wherein said spindle with said spindle driver is mounted for varying a length thereof.

28. The scissor jack according to claim 1, wherein said telescopically variable arms are configured for collapsing the scissor jack to a minimum volume for stowage.

* * * * *